US006305683B1

(12) United States Patent
Kim

(10) Patent No.: US 6,305,683 B1
(45) Date of Patent: Oct. 23, 2001

(54) FRONT LOADING TYPE OF AUTOMATIC PAPER FEEDING APPARATUS FOR PREVENTING PAPER FROM BEING SKEWED

(75) Inventor: Dong-Hun Kim, Anyang (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/553,025

(22) Filed: Apr. 20, 2000

(51) Int. Cl.[7] ..... B62H 3/30

(52) U.S. Cl. ..... 271/22; 271/21; 271/127; 271/170

(58) Field of Search ..... 271/19, 21, 22, 271/24, 118, 127, 169, 170, 245, 109, 126

(56) References Cited

U.S. PATENT DOCUMENTS

| | | | | |
|---|---|---|---|---|
| 2,289,501 | * | 7/1942 | Kauffeld | 271/22 |
| 4,607,834 | | 8/1986 | Dastin . | |
| 4,874,160 | | 10/1989 | Yamamoto . | |
| 4,907,792 | | 3/1990 | Washiashi et al. . | |
| 5,104,109 | * | 4/1992 | Kubo | 271/126 |
| 5,172,903 | | 12/1992 | Haneda et al. . | |
| 5,253,854 | | 10/1993 | Tanoue et al. . | |
| 5,335,899 | | 8/1994 | Golicz . | |
| 5,893,555 | * | 4/1999 | Kawada et al. | 271/126 |
| 5,927,702 | | 7/1999 | Ishii et al. . | |
| 6,024,356 | * | 2/2000 | Tanaka et al. | 271/118 |
| 6,129,347 | * | 10/2000 | Brooks et al. | 271/22 |

FOREIGN PATENT DOCUMENTS

WO89/04804 * 6/1989 (WO) ..... 271/24

* cited by examiner

*Primary Examiner*—H. Grant Skaggs
(74) *Attorney, Agent, or Firm*—Robert E. Bushnell, Esq.

(57) ABSTRACT

An improved front type of automatic paper feeding apparatus having a paper aligning device for preventing a skewing of a paper to be fed. In the front loading type of automatic paper feeding apparatus including a paper storing and separating section for storing paper to be fed and for separating sheets of paper one by one; a cam device for raising and lowering the paper storing and separating section; and a feeding section having a feed roller which rotates to separate a sheet of paper from the paper storing and separating section and to convey the separated sheet of paper to a printing position, the automatic paper feeding apparatus for preventing paper skew further includes an aligning roller for aligning the paper by pushing the paper stored in the paper storing and separating unit to a paper feeding position, the aligning roller pivoting in contact with the paper for paper aligning before the feed roller comes into contact with the paper; a slip section formed of a slip gear which is disposed on the aligning roller shaft for providing a rotational force to the aligning roller; a feed gear for providing a driving force to the slip gear; a holder lever for pivoting the feed roller, the holder lever on which the slip gear and aligning roller are disposed to variably perform the paper aligning operation and pickup operation; and an elastic member opposed to the aligning roller, for providing a certain force to the aligning roller for the paper aligning operation.

23 Claims, 7 Drawing Sheets

FRONT LOADING TYPE OF AUTOMATIC PAPER FEEDING APPARATUS FOR PREVENTING PAPER FROM BEING SKEWED

BACKGROUND OF THE INVENTION

1. Field of the Invention

The present invention relates to an improved front loading type of automatic paper feeding apparatus for preventing the skewing of paper being fed, by providing a paper aligning device for aligning the paper before the paper feeding.

2. Description of the Related Art

Generally, an image forming apparatus such as an ink jet printer, etc. employs an automatic paper feeding apparatus for feeding a sheet of paper. In such an image forming apparatus, a so-called "paper skew" may occur due to the skew paper feeding, resulting in a skewed image printed on the paper.

The paper skew is caused by an unsmooth paper path due to a system or assembling error, or by an unstable positioning of the paper in a paper feeding apparatus.

FIGS. 1 to 3 show the above-mentioned problems of the related art. Referring to FIG. 1, a lever 2 and a bevel gear 3 are driven by the movement of a carriage 1, and as shown in FIG. 2, a cam 5 is moved by a shaft 4 to thereby push a knock-up plate 6 upward and press the paper (P) into tight contact with a feed roller 7.

Next, in the above position, the carriage 1 rotates the feed roller 7 toward a paper feeding position (counterclockwise direction in FIG. 2). Accordingly, the paper (P) is picked up, conveyed along a guiding rib 8, and stopped at the printing position. Then, the carriage 1 leaves from the pickup position, to perform the printing operation. In such a situation, by the movement of a separator 9, the top paper of a plurality of loaded paper, that is in direct contact with the feed roller 7, is picked up first.

In such a structure, when the paper (P) is not orderly arranged in a cassette 10, the paper (P) is firmly secured by the feed roller 7 during the movement of the cam shaft 4 and the cam 5 in the skewed state, and as the feed roller 7 is rotated, the skewed paper (P) is conveyed to the printing operation. Accordingly, the image is also skewed when printed on the skewed paper (P).

SUMMARY OF THE INVENTION

The present invention has been developed to overcome the above-mentioned problems of the related art, and accordingly, it is an object of the present invention to provide an improved automatic paper feeding apparatus for preventing a printing deterioration due to a paper skew which is caused due to a careless paper loading, by horizontally aligning the paper before the pick up and printing operation.

In order to accomplish the above object, in a front loading type of automatic paper feeding apparatus including: a paper storing and separating section for storing paper to be fed and for separating the sheets of paper one by one; a cam device for raising and lowering the paper storing and separating section; and a feeding section having a feed roller which rotates to separate a sheet of paper from the paper storing and separating section and to convey the separated sheet of the paper to the printing position, the automatic paper feeding apparatus for preventing a paper skew according to the present invention further includes an aligning roller for aligning the paper by pushing each sheet of paper stored in the paper storing and separating section to a paper feeding position, the aligning roller pivoting in contact with the paper for paper aligning before the feed roller comes into contact with the paper; a slip section formed of a slip gear which is disposed on the aligning roller shaft for providing a rotational force to the aligning roller; a feed gear for providing a driving force to the slip gear; a holder lever for pivoting the feed roller, the holder lever on which the slip gear and aligning roller are disposed to variably perform the paper aligning operation and pickup operation; and an elastic member opposed to the aligning roller, for providing a certain force to the aligning roller for the paper aligning operation.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

The apparatus according to the preferred embodiment will be described in greater detail with reference to the accompanying drawings.

Figure 1:
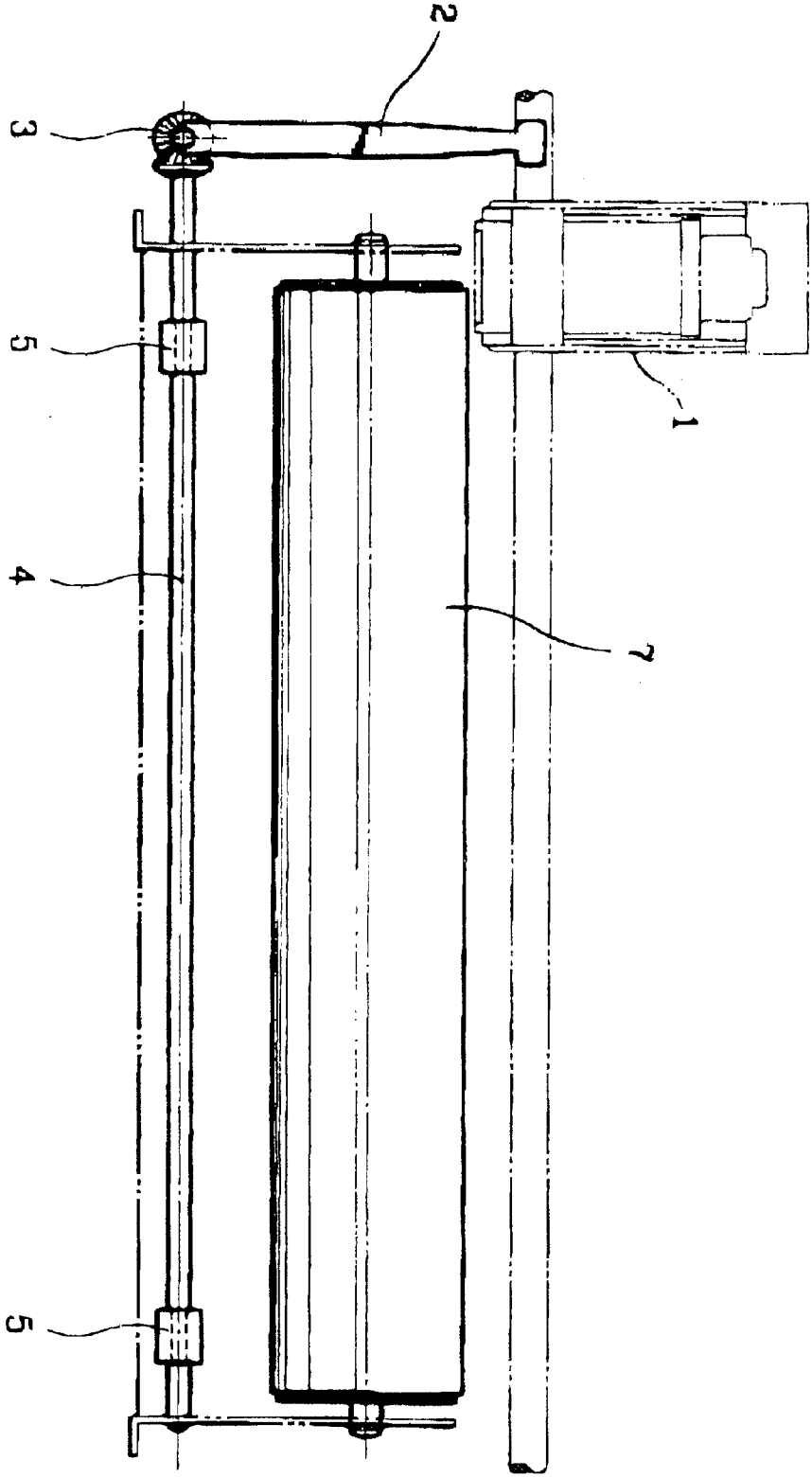
FIG. 1 is a schematic view for explaining a conventional automatic paper feeding apparatus.
Figure 2:
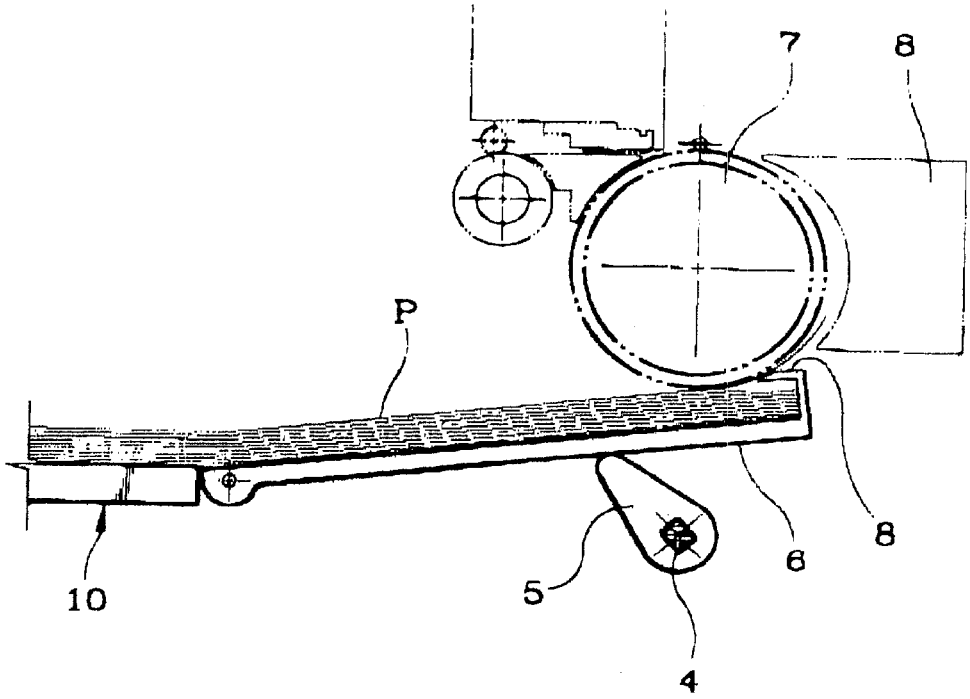
FIG. 2 is a schematic sectional view for showing the disadvantages of the conventional automatic paper feeding apparatus.
Figure 3:
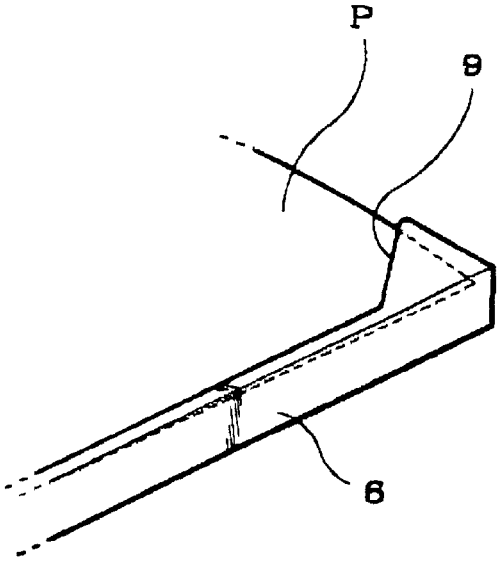
FIG. 3 is a perspective view for partially showing a conventional paper separating section.
Figure 4:
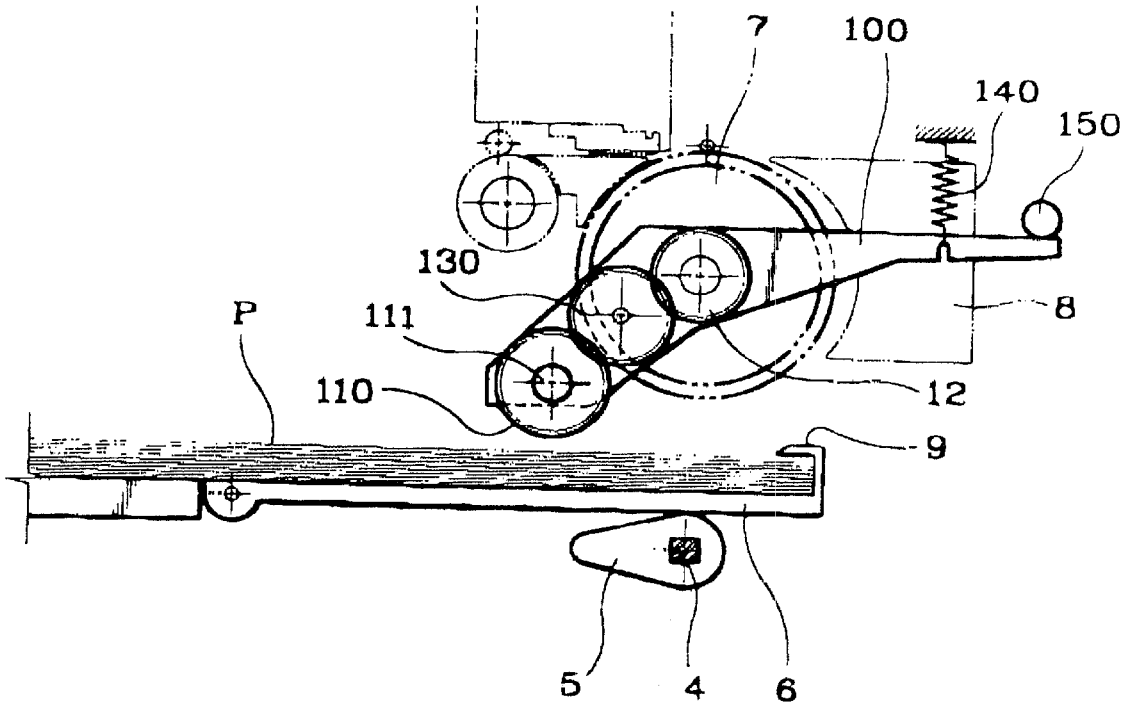
FIG. 4 is a sectional view for showing an apparatus according to the present invention.
Figure 5:
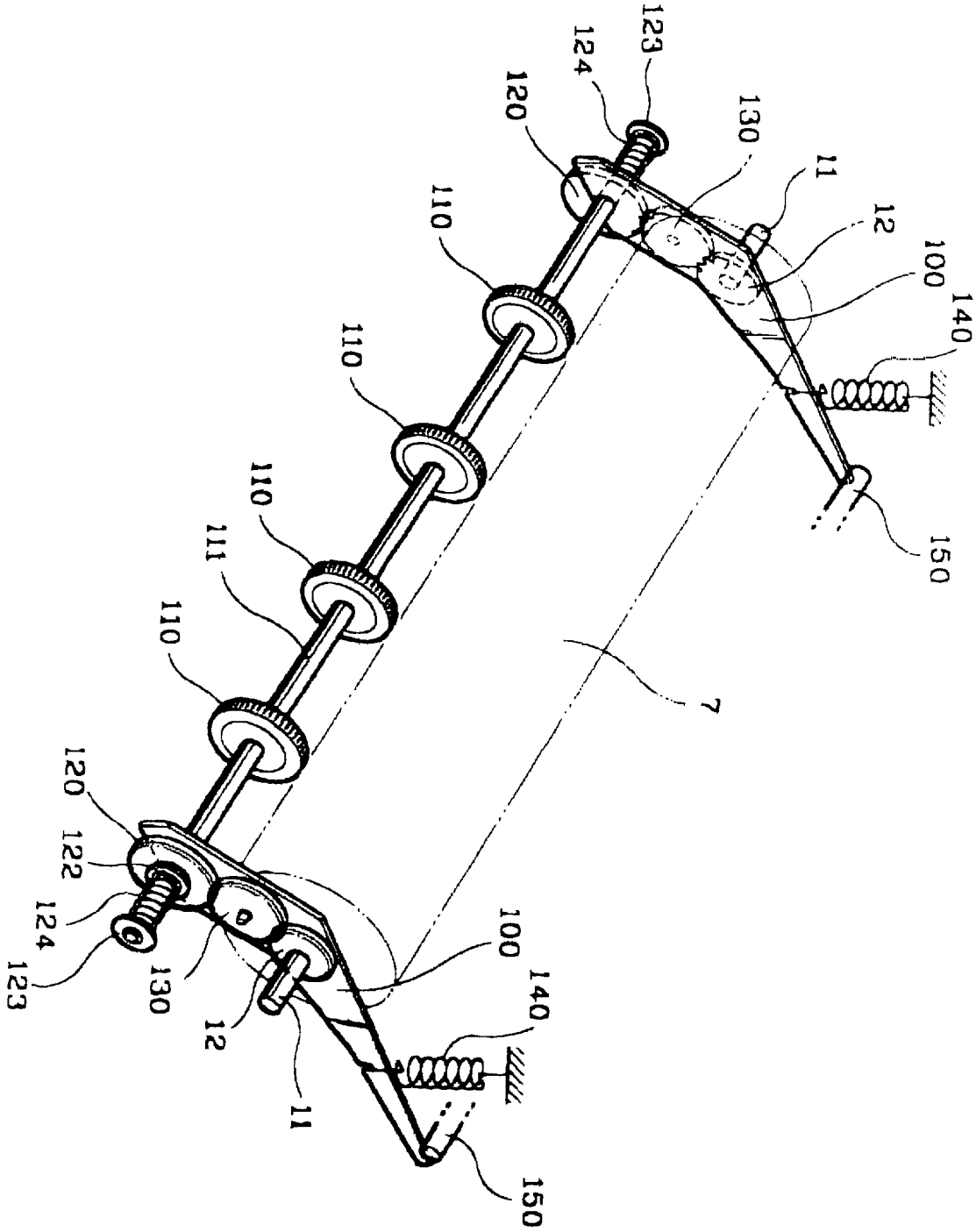
FIG. 5 is a perspective view of the apparatus according to the present invention.

FIG. 4 is a sectional view of the apparatus according to the present invention, and FIG. 5 is a perspective view for showing the apparatus according to the present invention in greater detail. The apparatus according to the present invention includes a knock-up plate 6 on which a plurality of paper (P) is piled, a cam 5 for lifting the knock-up plate 6, and a cam shaft 4 for rotatably moving the cam 5.

Further, the apparatus according to the present invention includes a feed roller 7 which pivotally moves to feed the paper (P), and a guiding rib 8 for guiding the paper (P) which is fed by the feeding roller 7.

The feed roller 7 is rotatably secured on a feed roller shaft 11 which has a feed gear 12 rotated by an external driving source (motor).

Further, the apparatus according to the present invention includes a holder lever 100 pivoted on the feed roller shaft 11, while an aligning roller shaft 111 having a plurality of aligning rollers 110 is pivotally disposed on the leading edge of the holder lever 100.

The aligning roller shaft 111 includes a slip gear 120 disposed on one side thereof, for pivoting the aligning roller shaft 111.

The slip gear 120 receives a rotational force from the feed gear 12 via an idle gear 130 for aligning a rotational direction.

The rear end of the holder lever 100 is pulled by an elastic member 140 so as to permit the aligning rollers 110 to push downward. Here, the reference numeral 150 refers to a stopper for stopping the rising movement of the rear end of the holder lever 100.

Figure 6A:
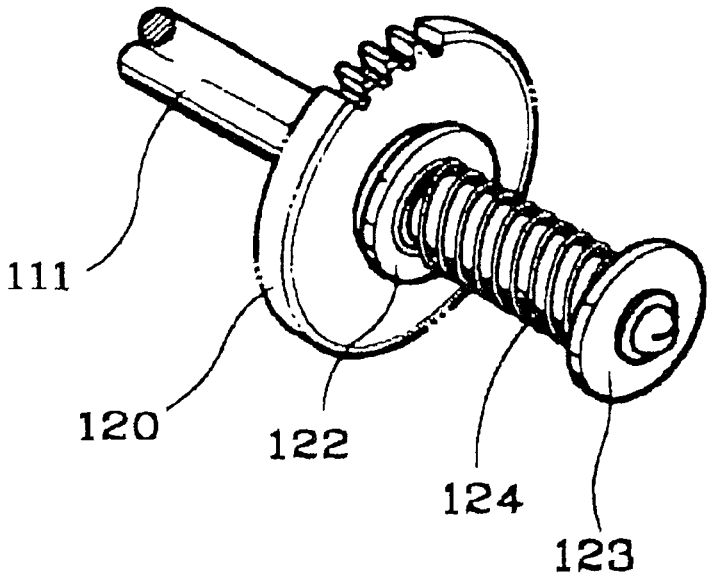
FIGS. 6A and 6B are a perspective view and a sectional view for showing a slip section according to the present invention.
Figure 6B:
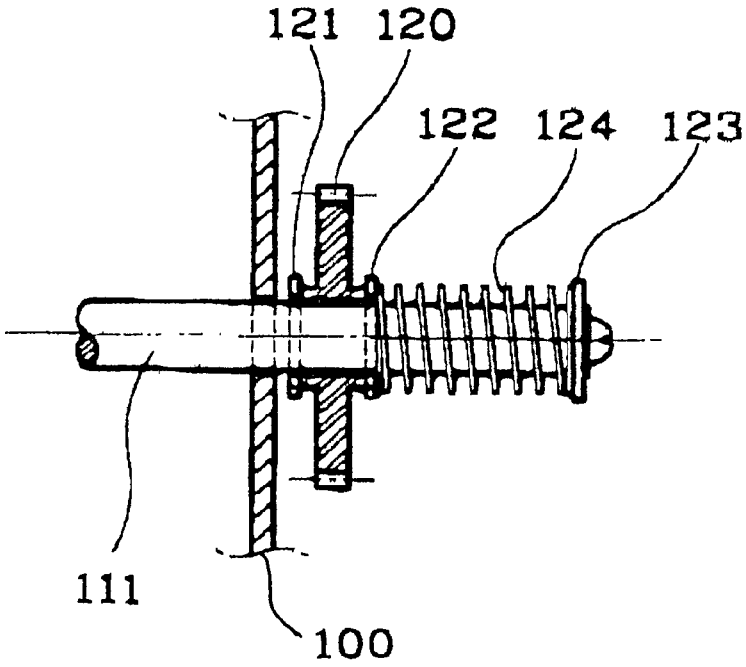

FIGS. 6A and 6B show the slip gear 120 in greater detail. Referring to FIGS. 6A and 6B, the slip gear 120 is loosely disposed on the aligning roller shaft 111 so as to be able to race. Such a slip gear 120 is in close contact with a secured frictional plate 121 which is secured on the aligning roller shaft 111. Further, a movable frictional plate 122 is formed opposite to the secured frictional plate 121 while the slip gear 120 is located between the movable frictional plate 122 and the secured frictional plate 121. The movable frictional plate 122 receives the elasticity from an elastic member 124 which is disposed between the movable friction plate 122 and a secured member 123 which is secured on the end of the aligning roller shaft 111.

The elastic member 124 is preferably made of a compression spring, and presses the movable friction plate 121. Accordingly, by the force exerted to the movable frictional plate 121, the slip gear 120 comes into tight contact with the secured frictional plate 121, and accordingly, the rotational force of the slip gear 120 is transmitted to the secured frictional plate 121, to rotate the aligning roller shaft 111, including the aligning rollers 110 disposed thereon.

Meanwhile, when a counteractive torque is generated greater than the frictional torque between the slip gear 120 and the secured frictional plate 121, the aligning roller shaft 111 with the aligning rollers 110 are stopped, but the slip gear 120 is rotated exclusively. Here, a slip situation occurs in which the slip gear 120 continuously slides between the secured frictional plate 121 and the movable frictional plate 122.

Figure 7A:
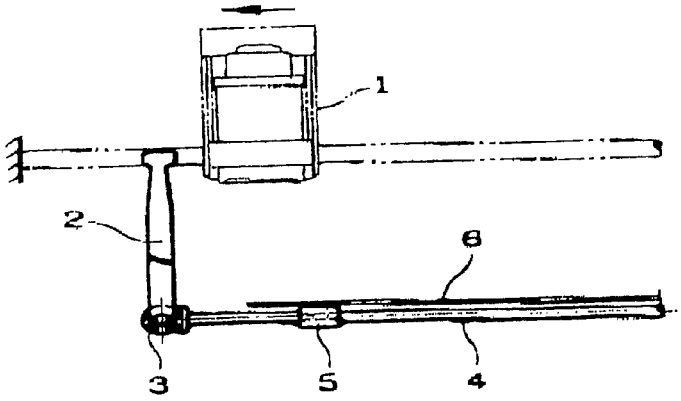
FIGS. 7A to 7C are schematic views for showing a cam device according to the present invention in respective positions.
Figure 7B:
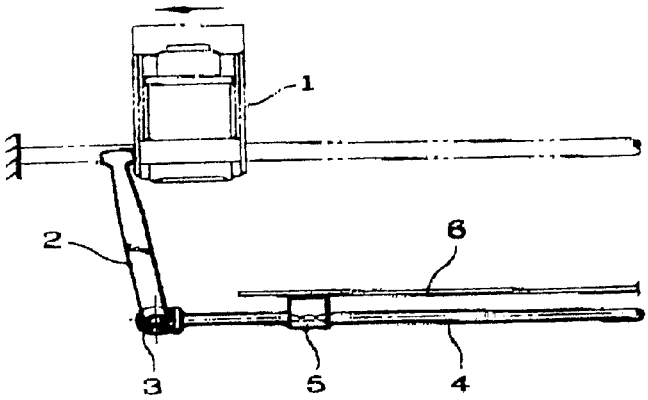
Figure 7C:
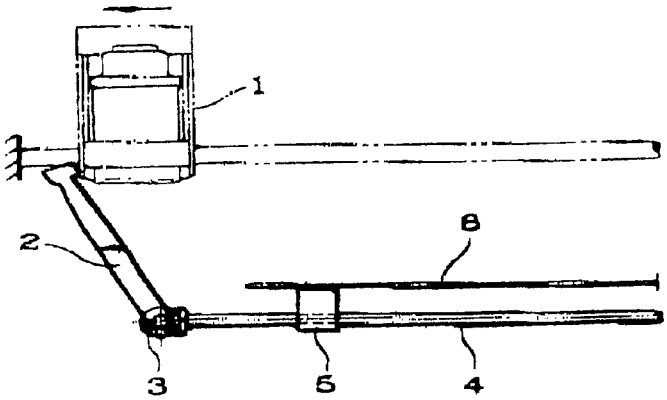

FIGS. 7A to 7C are views for explaining the rotational movement of the cam 5 for better understanding of the present invention.

FIG. 7A shows the carriage 1 prior to pivoting the lever 2, in which the cam shaft 4 is not pivoted, and the cam 5 does not lift the knock-up plate 6, i.e., in a "feeding standby mode".

FIG. 7B shows the carriage 1 pushing, thus pivoting the lever 2 to a certain position, and the cam shaft 4 being rotated by the movement of the bevel gear 3 to a certain degree to rotate the cam 5, and to lift the knock-up plate 6 to a "paper aligning position". In this situation, the carriage 1 reaches the paper aligning position, stopped for a certain period, and then moves.

FIG. 7C shows the carriage 1 inclining the lever 2 to an extreme degree, so that the cam shaft 4 and the cam 5 are completely rotated to lift the knock-up plate 6 to a "pickup position". Hereinafter, the above-described positions will be respectively called "feeding standby position", "paper aligning position", and "paper pickup position".

Referring back to FIG. 4, FIG. 4 shows the "feeding standby position". In this situation, an unstable paper loading may occur, in which the top paper (P) loaded in the cassette 10 is not in tight contact with the separator 9, or the like. When such an unstably set paper (P) is fed, the paper skew occurs, and in order to prevent this, the process of aligning the paper (P) is required.

Figure 8:
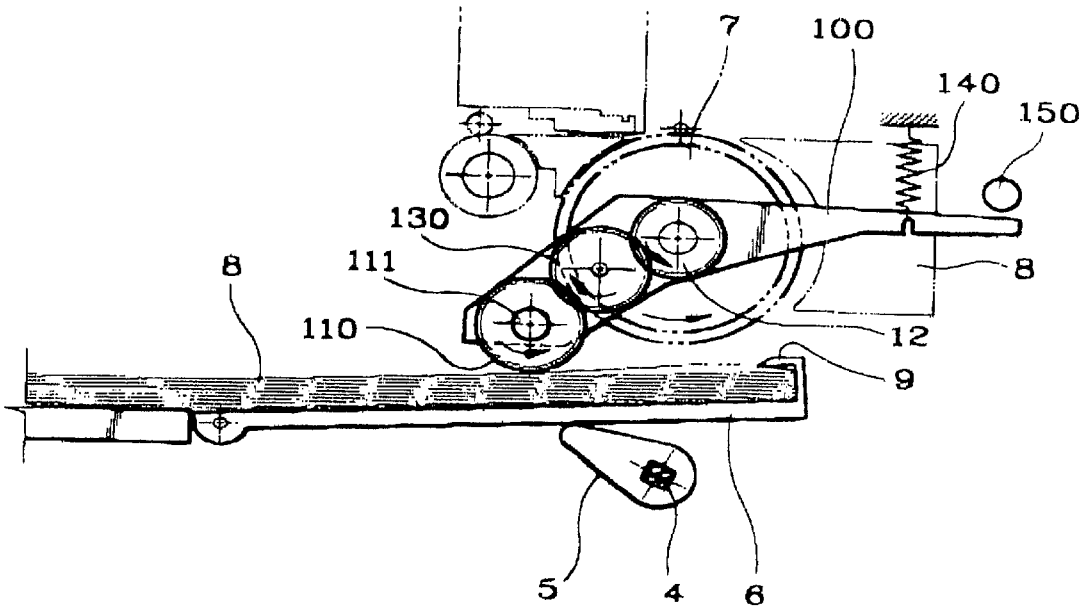
FIG. 8 is a sectional view for showing the operation of the apparatus according to the present invention.

FIG. 8 shows the cam 5 moved to the paper aligning position. In this situation, the cam is pivoted to lift the knock-up plate 6, until the top paper (P) comes into slight contact with the aligning rollers 110. When the top paper (P) comes into slight contact with the aligning rollers 110, the paper (P) is aligned. In this situation, the aligning rollers 110 slip-rotate, while continuously pushing the paper (P) against the separator 9. The paper aligning operation is performed instantly.

Figure 9:
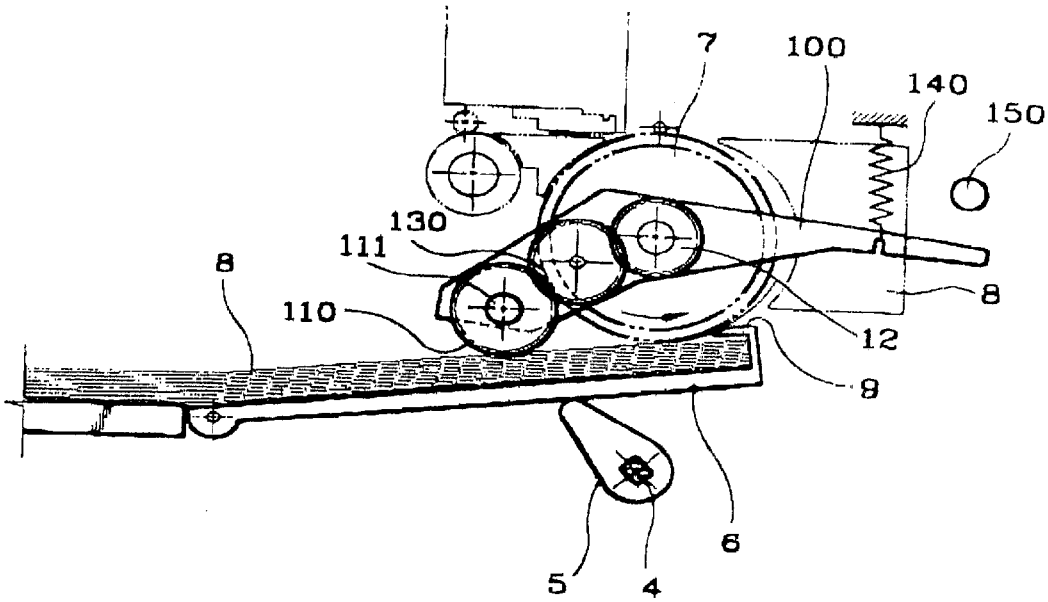
FIG. 9 is a sectional view for showing the paper feeding operation according to the present invention.

FIG. 9 shows the cam 5 pivoted to the paper pickup position, in which the paper (P) and the feed roller 7 are brought into contact with each other under more than a normal degree of force, while the paper (P) on the knock-up plate 6 is simultaneously moved to the printing position.

After completing the paper feeding, the cam 5 is returned to its initial position shown in FIG. 4, and the knock-up plate 6 is lowered down and standbys for the next feeding operation.

As described above, according to the present invention, since the top paper, which is to be picked up, is horizontally aligned before the pickup operation and conveyance thereof, the paper skew caused due to the carelessness of a user during a paper loading process is prevented, and high printing quality is obtained.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. In a front loading type of automatic paper feeding apparatus, comprising; paper storing and separating unit for storing sheets of paper to be fed and for separating sheets of paper one by one; a cam device for raising and lowering the paper storing and separating unit; and feeding unit having a feed roller which rotates on a feed roller shaft to separate a sheet of paper from the paper storing and separating unit and to convey the separated sheet of paper to a printing position, the automatic paper feeding apparatus further comprising:

an aligning roller for aligning the paper by pushing the paper stored in the paper storing and separating unit to a paper feeding position, the aligning roller pivoting in contact with the paper for paper alignment before the feed roller comes into contact with each sheet of paper;

a slip unit formed of a slip gear which is disposed on the aligning roller shaft for providing a rotational force to the aligning roller;

a feed gear for providing a driving force to the slip gear;

a holder lever for pivoting on the feed roller shaft, the holder lever on which the slip gear and aligning roller are disposed to variably perform the paper aligning operation and pickup operation; and an elastic member opposed to the aligning roller, for providing a certain force to the aligning roller for the paper aligning operation.

2. The apparatus as claimed in claim 1, the slip unit, comprising: a secured frictional plate secured on the aligning roller shaft; a movable frictional plate opposed to the secured frictional plate while the slip gear in contact with the secured frictional plate is located between the movable frictional plate and the secured frictional plate; an elastic member for providing an elasticity to the movable frictional plate; and a securing member secured on the aligning roller shaft for preventing the separation of the elastic member.

3. The apparatus as claimed in claim 1, the rotational force of the feed gear being transmitted to the slip gear via an idle gear for shifting the rotational direction.

4. The apparatus as claimed in claim 1, the holder lever being moved on the feed roller shaft to variably perform the aligning operation and pickup operation.

5. The apparatus as claimed in claim 1, the elastic member, providing a certain elasticity between the aligning roller and the paper during the paper aligning operation, and the operation of the holder lever being controlled by a degree of movement which is determined between the elastic member and a stopper.

6. An apparatus, comprising:

a first roller pivotally moving to feed a printable medium from a stack of printable mediums, said first roller being rotatably secured on a first shaft rotated by an external driving unit;

a rib guiding said printable medium fed by said first roller;

a lever pivoted on said first shaft;

a second roller having a second shaft pivotally disposed on a leading edge of said lever, said second roller aligning said printable medium by pushing said printable medium stored in a printable medium storing and separating unit into a feeding position;

a first gear formed on said second shaft and receiving a rotational force, said first gear loosely disposed on said second shaft;

a first frictional plate in close contact with said first gear, said first frictional plate being secured on said second shaft;

a first elastic member pulling a rear end of said lever permitting said second roller to push downward;

a second frictional plate formed opposite to said first frictional plate, said first gear located in between said second frictional plate and said first frictional plate, said second frictional plate being movable on said second shaft; and a second elastic member providing elasticity to said second frictional plate against said first gear, said second elastic member disposed between said second frictional plate and a securing member, said securing member secured on an end of said second shaft.

7. The apparatus of claim 6, further comprising a second gear coupled to said first shaft, said second gear rotating according to rotation of said first roller, a rotational force of said second gear transmitted to said first gear.

8. The apparatus of claim 7, with said first gear being a slip gear, said slip gear rotating said second shaft and slipping against said second shaft, the rotating and slipping motion of said slip gear making a corresponding motion in said second roller.

9. The apparatus of claim 8, with said first shaft having a second gear rotated by the external driving unit, said slip gear receiving a rotational force from said second gear via a third gear aligning a rotational direction.

10. The apparatus of claim 9, further comprising a stopping unit disposed on said lever preventing a rising movement of a rear end of said lever beyond a certain limit.

11. The apparatus of claim 10, with said second elastic member applying a force on said second frictional plate and said slip gear, the force from said second elastic member pressing said slip gear into contact with said first frictional plate, said slip gear having a rotational force transmitted to said first frictional plate to rotate said second shaft with said second roller.

12. The apparatus of claim 11, with said second shaft disposed on a leading edge of said lever.

13. The apparatus of claim 12, with said second shaft and said second roller stopping rotation and said slip gear rotating when a counteractive torque generated between said slip gear and said first frictional plate being greater than a frictional torque between said slip gear and said second frictional plate.

14. The apparatus of claim 13, further comprising:

a plate supporting the stack of printable mediums; and a cam rotatably moving on a third shaft, said cam lifting said plate to align said printable medium.

15. The apparatus of claim 14, further comprising a plurality of second rollers on said second shaft along a width of said printable medium, said plurality of second rollers aligning said printable medium when said cam lifts said printable medium into contact with said plurality of second rollers.

16. A method of aligning printable medium on a printable medium storing and separating unit for storing sheets of printable mediums to be fed and separated one by one in a printable medium feeding apparatus, comprising the steps of: upwardly pivoting a first roller in response to the upward movement of said printable medium storing and separating unit when a printable medium contacts said first roller before a second roller, mounted directly above the printable medium storing and separating unit, contacts and feeds said printable medium from said printable medium storing and separating unit; and aligning said printable medium by forwardly pushing said printable medium, using said first roller, against said printable medium storing and separating unit before the second roller comes into contact with said printable medium.

17. The method of claim 1, with said printable medium separating unit being a member of a container holding said printable medium before feeding said printable medium, a first frictional plate being secured to a first shaft coupled to said first roller, a second frictional plate being movable on said first shaft.

18. The method of claim 17, with said pivoting of said first roller further providing a rotational force applied by a slip unit to said first roller, said slip unit having a slip gear disposed between said first and second frictional plates, said slip gear in frictional contact with said first and second friction plates while rotating, a first resilient member pushing said second frictional plate against said slip gear.

19. The method of claim 18, with said aligning of said printable medium being when a cam pivots a third plate holding said printable medium until said printable medium being in contact with said first roller.

20. The method of claim 19, further comprising stopping said first roller and continuously sliding said slip gear rotating between said first frictional plate and said second frictional plate when a counteractive torque generated between said slip gear and said first frictional plate being greater than a frictional torque.

21. The method of claim 20, with said first roller having an elastic contact with said printable medium through a resilient member providing an elastic downward force on said second roller to said printable medium.

22. The method of claim 21, with said second roller having a rotation corresponding to the rotation of a second gear, a rotational force of said second gear transmitted to said slip gear.

23. The method of claim 22, with said slip gear rotating said first shaft and slipping against said first shaft, the rotating and slipping motion of said slip gear making a corresponding motion in said first roller.

* * * * *